US009324316B2

(12) United States Patent
Mitsui et al.

(10) Patent No.: US 9,324,316 B2
(45) Date of Patent: Apr. 26, 2016

(54) PROSODY GENERATOR, SPEECH SYNTHESIZER, PROSODY GENERATING METHOD AND PROSODY GENERATING PROGRAM

(75) Inventors: Yasuyuki Mitsui, Tokyo (JP); Reishi Kondo, Tokyo (JP); Masanori Kato, Tokyo (JP)

(73) Assignee: NEC CORPORATION, Tokyo (JP)

( * ) Notice: Subject to any disclaimer, the term of this patent is extended or adjusted under 35 U.S.C. 154(b) by 104 days.

(21) Appl. No.: 14/004,148

(22) PCT Filed: May 10, 2012

(86) PCT No.: PCT/JP2012/003061

§ 371 (c)(1),
(2), (4) Date: Sep. 9, 2013

(87) PCT Pub. No.: WO2012/164835

PCT Pub. Date: Dec. 6, 2012

(65) Prior Publication Data

US 2014/0012584 A1 Jan. 9, 2014

(30) Foreign Application Priority Data

May 30, 2011 (JP) ..... 2011-120499

(51) Int. Cl.
*G10L 13/00* (2006.01)
*G10L 13/027* (2013.01)
*G10L 13/10* (2013.01)

(52) U.S. Cl.
CPC ..... *G10L 13/027* (2013.01); *G10L 13/10* (2013.01)

(58) Field of Classification Search
USPC ..... 704/257–261
See application file for complete search history.

(56) References Cited

U.S. PATENT DOCUMENTS 6,826,531 B2 11/2004 Fukada
7,155,390 B2 12/2006 Fukada
(Continued)

FOREIGN PATENT DOCUMENTS

JP S64-078300 A 3/1989
JP H09-222898 A 8/1997
(Continued)

OTHER PUBLICATIONS

Hiroya Fujisaki and Hiroshi Sudo, "A Model for the Generation of Fundamental Frequency Contours of Japanese Word Accent", The Acoustical Society of Japan, Journal of the Acoustical Society of Japan, Vo. 27, No. 9, pp. 445-452, 1971.
Keiich Tokuda, "Speech Synthesis Based on Hidden Markov Models", The Institute of Electronics, Information and Communication Engineers (IEICE), IEICE technical report SP99-61, pp. 47-54, 1999.

*Primary Examiner* — Leonard Saint Cyr
(74) *Attorney, Agent, or Firm* — McGinn IP Law Group, PLLC.

(57) ABSTRACT

There is provided a prosody generator that generates prosody information for implementing highly natural speech synthesis without unnecessarily collecting large quantities of learning data. A data dividing means 81 divides into subspaces the data space of a learning database as an assembly of learning data indicative of the feature quantities of speech waveforms. A density information extracting means 82 extracts density information indicative of the density state in terms of information quantity of the learning data in each of the subspaces divided by the data dividing means 81. A prosody information generating method selecting means 83 selects either a first method or a second method as a prosody information generating method based on the density information, the first method involving generating the prosody information using a statistical technique, the second method involving generating the prosody information using rules based on heuristics.

17 Claims, 8 Drawing Sheets

(56) References Cited

U.S. PATENT DOCUMENTS

| | | | | |
|---|---|---|---|---|
| 2001/0032078 | A1 | 10/2001 | Fukada | |
| 2005/0055207 | A1 | 3/2005 | Fukada | |
| 2008/0177543 | A1* | 7/2008 | Nagano et al. | 704/253 |
| 2012/0166365 | A1* | 6/2012 | Tur et al. | 706/11 |

FOREIGN PATENT DOCUMENTS

| | | | |
|---|---|---|---|
| JP | 2001-282282 | A | 10/2001 |
| JP | 2002-268660 | A | 9/2002 |
| JP | 2008-176132 | A | 7/2008 |

* cited by examiner

PROSODY GENERATOR, SPEECH SYNTHESIZER, PROSODY GENERATING METHOD AND PROSODY GENERATING PROGRAM

TECHNICAL FIELD

The present invention relates to a prosody generator, a prosody generating method, and a prosody generating program for generating prosody information for use in speech synthesis processing, as well as to a speech synthesizer, a speech synthesizing method, and a speech synthesizing program for generating speech waveforms.

BACKGROUND ART

With advances in text-to-speech (TTS) synthesis technology, recent years have witnessed the advent of numerous services and products that use human-like synthesized speech. Generally, TTS involves first getting the linguistic structure and other aspects of input text analyzed by morphological analysis (language analysis processing). The result of the analysis is then used as the basis for generating phoneme information furnished with accents and other information. Furthermore, based on pronunciation information, fundamental frequency patterns and phoneme duration time are estimated (prosody generation processing). On the basis of the prosody information and phoneme information thus generated, waveforms are ultimately generated (waveform generation processing). In the ensuing description, the fundamental frequency will be represented by F0 and the fundamental frequency patterns will be represented by the F0 patterns. The prosody information generated by prosody generation processing is information which designates the sound pitch and tempo of synthesized speech and which includes the F0 patterns and the duration time information about each phoneme, for example.

As one way to perform the above-mentioned prosody generation processing, there is a known method involving modeling the F0 patterns so that the F0 patterns can be represented by simple rules and using these rules to generate prosody information (e.g., see Non Patent Literature 1). The way to generate prosody information using rules, such as the method described in Non Patent Literature 1, has been used extensively because it can generate the F0 patterns in a simple model.

Also in recent years, speech synthesizing methods utilizing statistical techniques have been drawing attention. One such representative method is HMM speech synthesis that uses Hidden Markov Models (HMM) as the statistical technique (e.g., see Non Patent Literature 2). HMM speech synthesis involves generating speech using a prosody model and a speech synthesis unit (parameter) model prepared from large quantities of learning data. HMM speech synthesis utilizes the speech actually pronounced by humans as the learning data, so that this method can generate more human-like prosody information than the method of generating prosody information using rules described in Non Patent Literature 1.

CITATION LIST

Non Patent Literature

Non Patent Literature 1

Hiroya Fujisaki and Hiroshi Sudo, "A Model for the Generation of Fundamental Frequency Contours of Japanese Word Accent," The Acoustical Society of Japan, Journal of the Acoustical Society of Japan, Vo. 27, No. 9, pp. 445-452, 1971.

Non Patent Literature 2

Keiich Tokuda, "Speech Synthesis Based on Hidden Markov Models," The Institute of Electronics, Information and Communication Engineers (IEICE), IEICE technical report SP99-61, pp. 47-54, 1999.

SUMMARY OF INVENTION

Technical Problem

The methods of generating prosody information using rules, such as the one described in Non Patent Literature 1, can generate the F0 patterns in a simplified model. However, the methods have problems: prosody is unnatural, and synthesized speech sounds mechanical.

By contrast, the methods of generating prosody information using statistical techniques, such as the one described in Non Patent Literature 2, employ as learning data the speech actually pronounced by humans, so that they permit generation of more human-like prosody information.

However, the prosody generation processing using statistical techniques involves dividing a learning data space into clusters (clustering) based primarily on the information quantity of the learning data. This leads to the problem of causing sparse and dense portions to appear in the learning data space. In the sparse portion inside the learning data space (i.e., where the learning data is sparse), correct F0 patterns are not generated. For example, in the case of learning data composed of several morae, such as "hi to (human)" in Japanese (consisting of 2 morae), "ta n go (word)" in Japanese (3 morae), or "o n se (speech)" in Japanese (4 morae), correct F0 patterns are generated because there is d sufficient quantity of learning data. On the other hand, the learning data such as "a ru ba- to a i n syu ta i n i ka da i ga ku (Albert Einstein College of Medicine)" (18 morae) can be very few or nonexistent. Thus if a text containing such words is input, F0 patterns are disturbed and such problems as displaced accent positions may occur.

Conceivably, one way to solve the problems above is to learn models with more quantities of data. However, this is not a realistic approach because it is difficult to collect large quantities of learning data and because it is not clear how much data needs to be collected as sufficient data for the purpose.

It is therefore an object of the present invention to provide a prosody generator, a prosody generating method, a prosody generating program, a speech synthesizer, a speech synthesizing method, and a speech synthesizing program for generating the prosody information for implementing highly natural speech synthesis without unnecessarily collecting large quantities of learning data.

Solution to Problem

According to the present invention, there is provided a prosody generator including: a data dividing means which divides into subspaces the data space of a learning database as an assembly of learning data indicative of the feature quantities of speech waveforms; a density information extracting means which extracts density information indicative of the density state in terms of information quantity of the learning data in each of the subspaces divided by the data dividing means; and a prosody information generating method selecting means which selects either a first method or a second method as a prosody information generating method based on the density information, the first method involving generating the prosody information using a statistical technique, the second method involving generating the prosody information using rules based on heuristics.

Also according to the present invention, there is provided a speech synthesizer including: a data dividing means which divides into subspaces the data space of a learning database as an assembly of learning data indicative of the feature quantities of speech waveforms; a density information extracting means which extracts density information indicative of the density state in terms of information quantity of the learning data in each of the subspaces divided by the data dividing means; a prosody information generating method selecting means which selects either a first method or a second method as a prosody information generating method based on the density information, the first method involving generating the prosody information using a statistical technique, the second method involving generating the prosody information using rules based on heuristics; a prosody generating means which generates the prosody information by the prosody information generating method selected by the prosody information generating method selecting means; and a waveform generating means which generates a speech waveform using the prosody information.

Also according to the present invention, there is provided a prosody generating method including: dividing into subspaces the data space of a learning database as an assembly of learning data indicative of the feature quantities of speech waveforms; extracting density information indicative of the density state in terms of information quantity of the learning data in each of the subspaces obtained by the division; and selecting either a first method or a second method as a prosody information generating method based on the density information, the first method involving generating the prosody information using a statistical technique, the second method involving generating the prosody information using rules based on heuristics.

Also according to the present invention, there is provided a speech synthesizing method including: dividing into subspaces the data space of a learning database as an assembly of learning data indicative of the feature quantities of speech waveforms; extracting density information indicative of the density state in terms of information quantity of the learning data in each of the subspaces obtained by the division; selecting either a first method or a second method as a prosody information generating method based on the density information, the first method involving generating the prosody information using a statistical technique, the second method involving generating the prosody information using rules based on heuristics; generating the prosody information by the selected prosody information generating method; and generating a speech waveform using the prosody information.

Also according to the present invention, there is provided a prosody generating program for causing a computer to execute a procedure including: a data dividing process which divides into subspaces the data space of a learning database as an assembly of learning data indicative of the feature quantities of speech waveforms; a density information extracting process which extracts density information indicative of the density state in terms of information quantity of the learning data in each of the subspaces divided by the data dividing process; and a prosody information generating method selecting process which selects either a first method or a second method as a prosody information generating method based on the density information, the first method involving generating the prosody information using a statistical technique, the second method involving generating the prosody information using rules based on heuristics.

Also according to the present invention, there is provided a speech synthesizing program for causing a computer to execute a procedure including: a data dividing process which divides into subspaces the data space of a learning database as an assembly of learning data indicative of the feature quantities of speech waveforms; a density information extracting process which extracts density information indicative of the density state in terms of information quantity of the learning data in each of the subspaces divided by the data dividing process; a prosody information generating method selecting process which selects either a first method or a second method as a prosody information generating method based on the density information, the first method involving generating the prosody information using a statistical technique, the second method involving generating the prosody information using rules based on heuristics; a prosody generating process which generates the prosody information by the prosody information generating method selected by the prosody information generating method selecting process; and a waveform generating process which generates a speech waveform using the prosody information.

Advantageous Effect of the Invention

According to the present invention, it is possible to generate prosody information for implementing highly natural speech synthesis without unnecessarily collecting large quantities of learning data.

It depicts a block diagram showing major units of a prosody generator as a first exemplary embodiment of the present invention.

FIG. 2

It depicts a block diagram showing more specifically the prosody generator as the first exemplary embodiment of this invention.

FIG. 3

It depicts a flowchart showing an example of operations of the first exemplary embodiment of this invention.

FIG. 4

It depicts a block diagram showing an example of a prosody generator as a second exemplary embodiment of the present invention.

FIG. 5

It depicts a flowchart showing an example of operations of the second exemplary embodiment of this invention.

FIG. 6

It depicts a block diagram showing a speech synthesizer as Example 1.

FIG. 7

It depicts a schematic view showing an example of a decision tree structure prepared by binary tree structure clustering.

FIG. 8

It depicts a schematic view showing an example of a learning data space divided into clusters.

FIG. 9

It depicts a block diagram showing a speech synthesizer as Example 2.

FIG. 10

It depicts a block diagram showing an example of a minimum configuration of the prosody generator according to this invention.

FIG. 11

It depicts a block diagram showing an example of a minimum configuration of the speech synthesizer according to this invention.

DESCRIPTION OF EMBODIMENTS

Some exemplary embodiments of the present invention are explained below in reference to the accompanying drawings.

First Exemplary Embodiment

Figure 1:
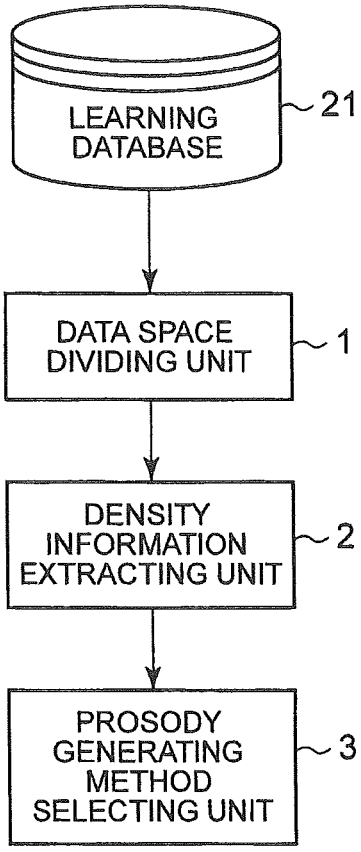
FIG. 1
Figure 2:
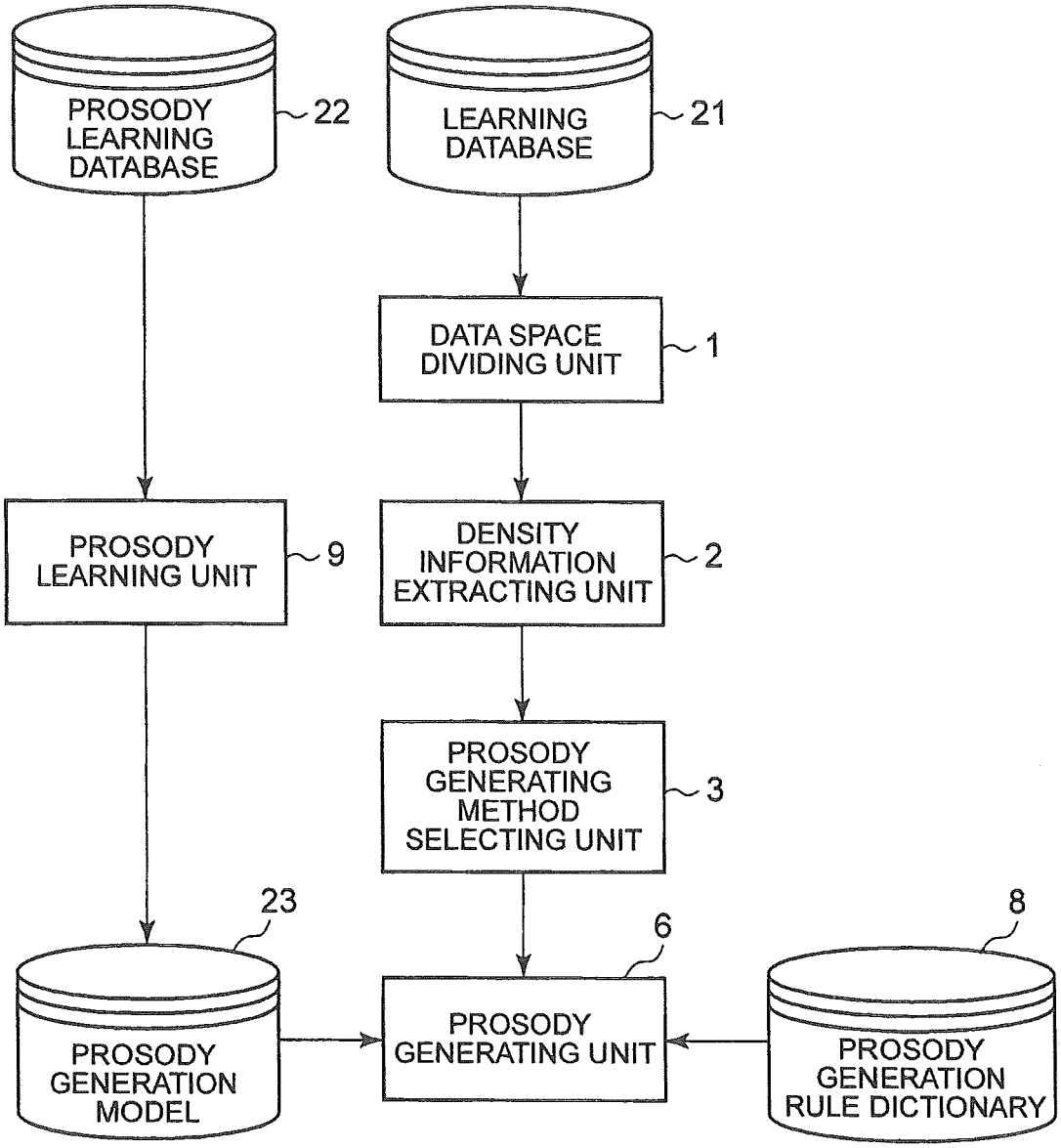

FIG. 1 is a block diagram showing the major units of the prosody generator as the first exemplary embodiment of the present invention. And FIG. 2 is a block diagram showing more specifically the prosody generator as the first exemplary embodiment of this invention. The prosody generator as the first exemplary embodiment according to this invention includes a data space dividing unit 1, a density information extracting unit 2, and a prosody generating method selecting unit 3. More specifically, in addition to the major units shown in FIG. 1, the prosody generator of this exemplary embodiment includes a prosody learning unit 9 and a prosody generating unit 6 (see FIG. 2).

The data space dividing unit 1 divides the feature quantity space of a learning database 21.

The learning database 21 is an assembly of learning data as the feature quantities extracted from speech waveform data. The feature quantities are composed of information expressed by numerals or character strings indicative of speech features and linguistic features. As such, the feature quantities include at least information about the time change of F0 (fundamental frequency) in speech waveforms (i.e., F0 patterns). Also, the learning database 21 should preferably include, as the feature quantities, spectrum information, phonemic segmentation information, and linguistic information indicative of the details of generated speech data.

The data space dividing unit 1 may divide the feature quantity space of the learning database 21 using, for example, a suitable method such as binary tree structure clustering based on information quantities.

The density information extracting unit 2 extracts information indicative of the density state (density level information) in terms of information quantity of the learning data in each of the subspaces divided by the data space dividing unit 1. In the ensuing description, that information will be referred to as the density information. For example, the mean value or variance value of a feature quantity vector for a group of learning data belonging to each of the subspaces obtained by division may be used as the density information. The density information extracting unit 2 may extract the density information using, as the feature quantity, the mora counts of accent phrases and relative positions of accent nuclei.

The learning database 21 is used to generate the density information. Besides the learning database 21 for generating the density information, the prosody generator of this exemplary embodiment holds a learning database 22 for generating a prosody generation model 23 (see FIG. 2; the database will be referred to as the prosody learning database 22 hereunder). Incidentally, the prosody generator may be furnished with a storing means (not shown) to store and hold the learning database 21 and a storing means (also not shown) to store and hold the prosody learning database 22.

The prosody learning unit 9 (see FIG. 2) generates the prosody generation model 23 using the prosody learning database 22. The prosody generation model 23 is a statistical model which is used to generate prosody information and the prosody generation model 23 represents the relations between speech and the prosody information. For example, as a result of statistical learning, the prosody generation model 23 may express the relations between speech and prosody information, indicating that "this type of speech generally possesses this kind of prosody information." The prosody learning unit 9 generates the prosody generation model 23 by mechanically learning the prosody learning database 22 using a statistical technique.

The prosody generating method selecting unit 3 selects the method for generating the prosody information for use in speech synthesis on the basis of the density information extracted by the density information extracting unit 2. As explained earlier, the prosody information is information that designates the sound pitch and tempo of synthesized speech. The prosody information includes at least the time change of fundamental frequency (i.e., F0 patterns) as the feature quantity representative of prosody. The candidate prosody information generating methods to be selected by the prosody generating method selecting unit 3 are constituted by the method of generating prosody information using a statistical technique exemplified by HMM (referred to as the statistical model-based method hereunder) and by the method of generating prosody information using rules based on heuristics (referred to as the rule-based method hereunder). For example, if the prosody information about the synthesized speech to be generated is expressed by the feature quantities belonging to a subspace having a small quantity of learning data (subspace with sparse learning data), the prosody generating method selecting unit 3 may select the rule-based method; otherwise the prosody generating method selecting unit 3 may select the statistical model-based method. In this case, the statistical model-based method may be usually selected. When the condition is met that the prosody information about the synthesized speech to be generated is expressed by feature quantities belonging to a subspace with sparse learning data, the rule-based method may be selected.

The prosody generating unit 6 (see FIG. 2) generates the prosody information by the prosody information selecting method selected by the prosody generating method selecting unit 3. Specifically, when the statistical model-based method is selected, the prosody generating unit 6 generates the prosody information using the prosody generation model 23; when the rule-based method is selected, the prosody generating unit 6 generates the prosody information using a prosody generation rule dictionary 8 that describes the rules for generating prosody information. The prosody generator may be furnished with a storing means (not shown) to store and hold the prosody generation rule dictionary 8.

The data space dividing unit 1, density information extracting unit 2, prosody generating method selecting unit 3, prosody learning unit 9, and prosody generating unit 6 may be implemented by the CPU of a computer that runs in accordance with a prosody generating program, for example. In this case, a program storage device (not shown) of the computer may store the prosody generating program. The CPU may read the stored program and operate as the data space dividing unit 1, density information extracting unit 2, prosody generating method selecting unit 3, prosody learning unit 9, and prosody generating unit 6 in keeping with the program. Alternatively, the data space dividing unit 1, density information extracting unit 2, prosody generating method selecting unit 3, prosody learning unit 9, and prosody generating unit 6 may each be implemented by separate hardware.

Figure 3:
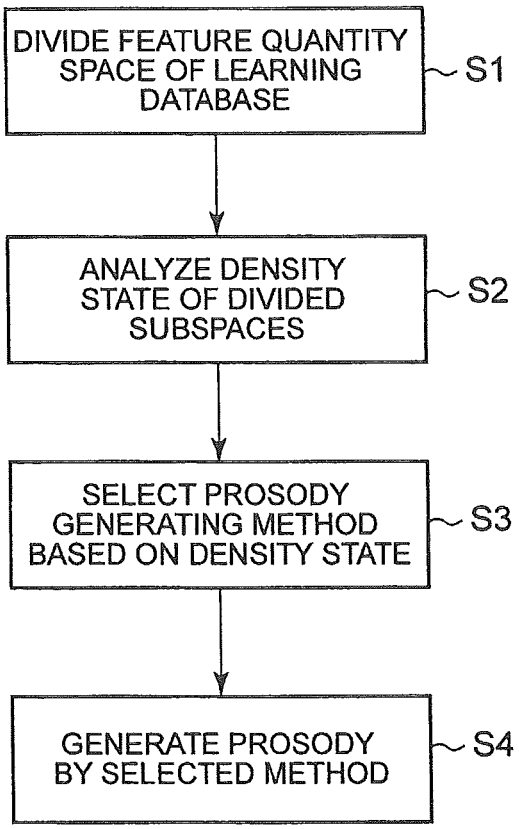

FIG. 3 is a flowchart showing an example of operations of the first exemplary embodiment of this invention. With the first exemplary embodiment, the data space dividing unit 1 first divides the feature quantity space of the learning database 21 (step S1). The density information extracting unit 2 then extracts the density information indicative of the density state in terms of information quantity of the learning data in each of the subspaces divided in step S1 (step S2). The density information extracting unit 2 may obtain a mean value or a variance value of feature quantities as the density information. Also, the mora counts of accent phrases and relative positions of accent nuclei may be used as the feature quantities.

Next, based on the density information, the prosody generating method selecting unit 3 selects the prosody information generating method for use in speech synthesis (step S3). The prosody generating unit 6 (see FIG. 2) then generates the prosody information by the prosody information selecting method selected by the prosody generating method selecting unit 3 in step S3 (step S4). When the statistical model-based method is selected in step S3, the prosody generating unit 6 generates the prosody information by the statistical model-based method using the prosody generation model 23. And when the rule-based method is selected in step S3, the prosody generating unit 6 generates the prosody information by the rule-based method using the prosody generation rule dictionary 8. Although not shown in the flowchart of FIG. 3, the prosody learning unit 9 may generate the prosody generation model 23 before step S4.

According to this exemplary embodiment, the rule-based method is selected for the prosody information belonging to sparse subspaces, so that the statistical model-based method will not be applied to such sparse subspaces. Thus there is no need to collect large quantities of learning data to deal with the sparse subspaces. This makes it possible to circumvent the instability in speech synthesis caused by insufficient learning data. Since the prosody information is ordinarily generated by the statistical model-based method, highly natural synthesized speech can be generated.

In addition to the elements shown in FIG. 2, there may be provided a waveform generating unit that generates speech waveforms using the prosody information generated by the prosody generating unit 6. When furnished additionally with that waveform generating unit, the prosody generator of this exemplary embodiment may be referred to as a speech synthesizer as well. The waveform generating unit above may be implemented by the CPU of a computer that operates in accordance with a program. That is, the CPU of the computer may function as the data space dividing unit 1, density information extracting unit 2, prosody generating method selecting unit 3, prosody learning unit 9, prosody generating unit 6, and the above-mentioned waveform generating unit in keeping with a suitable program. That program may be called a speech synthesizing program.

Second Exemplary Embodiment

Figure 4:
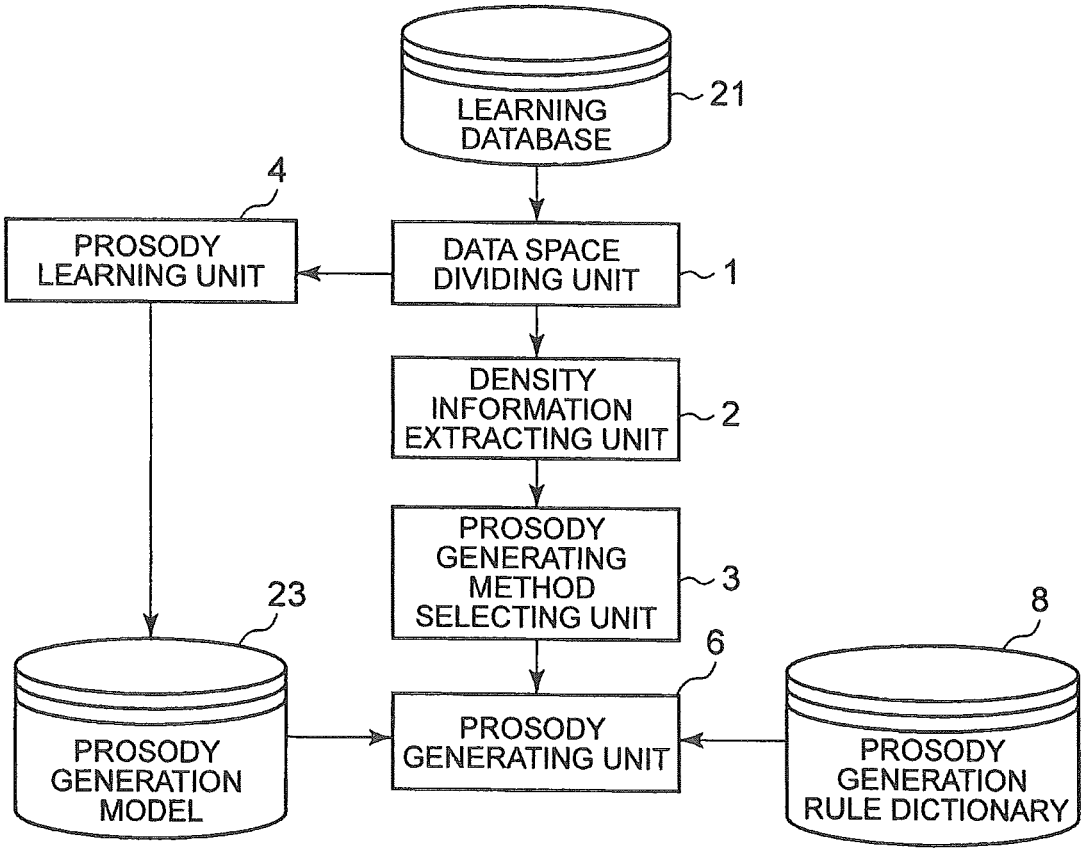

FIG. 4 is a block diagram showing an example of a prosody generator as the second exemplary embodiment of the present invention. The same elements as those of the first exemplary embodiment are designated by the same reference numerals indicated in FIGS. 1 and 2, and these elements will not be discussed further. The prosody generator as the second exemplary embodiment of this invention includes a data space dividing unit 1, a density information extracting unit 2, a prosody generating method selecting unit 3, a prosody learning unit 4, and a prosody generating unit 6.

The prosody learning unit 4 learns a prosody generation model within the learning database space divided by the data space dividing unit 1.

With this exemplary embodiment, the prosody learning unit 4 generates the prosody generation model 23 using the learning database 21 used for generating density information. This is what makes the prosody learning unit 4 different from its counterpart of the first exemplary embodiment, the prosody learning unit 9 of the first exemplary embodiment generating the prosody generation model 23 from the prosody learning database 22 furnished apart from the learning database 21. The prosody generation model 23 is used when the prosody generating method selecting unit 3 selects the statistical model-based method so that the prosody generating unit 6 generates the prosody information by the statistical model-based method.

The data space dividing unit 1, density information extracting unit 2, prosody generating method selecting unit 3, and prosody generating unit 6 are the same as their counterparts of the first exemplary embodiment.

The data space dividing unit 1, density information extracting unit 2, prosody generating method selecting unit 3, prosody learning unit 4, and prosody generating unit 6 may be implemented by the CPU of a computer that runs in accordance with a prosody generating program, for example. In this case, the CPU may operate as the data space dividing unit 1, density information extracting unit 2, prosody generating method selecting unit 3, prosody learning unit 4, and prosody generating unit 6 in keeping with the prosody generating program. Alternatively, these elements may each be implemented by separate hardware.

Figure 5:
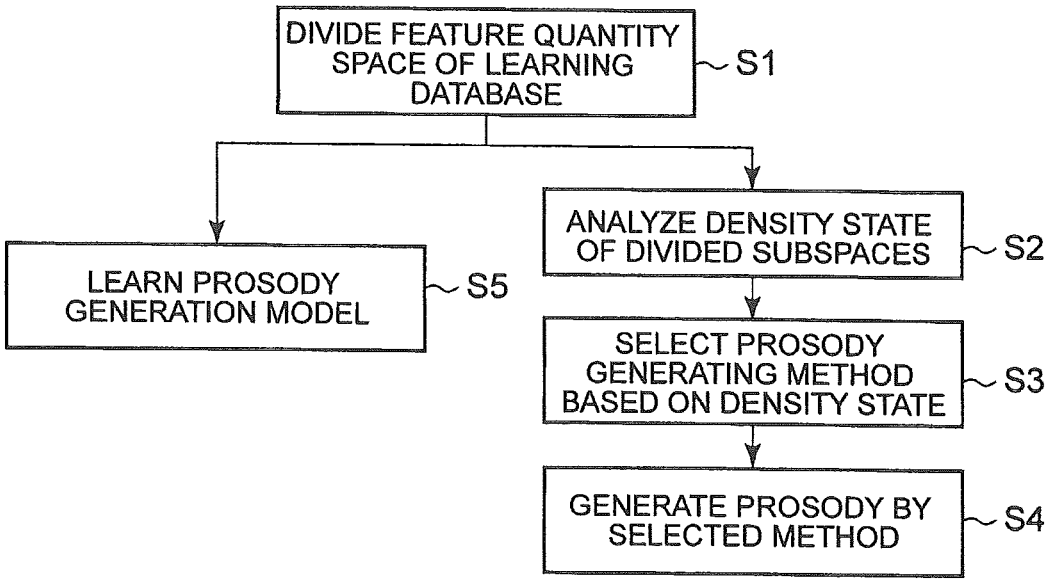

FIG. 5 is a flowchart showing an example of operations of the second exemplary embodiment of this invention. Steps S1 through S4 are the same as with the first exemplary embodiment and will not be discussed further in detail.

With the second exemplary embodiment, the prosody learning unit 4 after step S1 learns the prosody generation model 23 inside the learning database space divided by the data space dividing unit 1 (step S5). The prosody generating unit 6 generates the prosody information by the prosody information selecting method selected by the prosody generating method selecting unit 3 (step S4). At this point, if the statistical model-based method is selected in step S3, the prosody generating unit 6 generates the prosody information by the statistical model-based method using the prosody generation model 23 generated in step S5. And if the rule-based method is selected in step S3, the prosody generating unit 6 generates the prosody information by the rule-based method using the prosody generation rule dictionary 8.

According to this exemplary embodiment, the learning database used for generating the prosody generation model 23 is made the same as the learning database for selecting the prosody information generating method, so that the prosody information generating method for sparse subspaces within the prosody generation model is changed to the rule-based method. This makes it possible to circumvent F0 pattern disturbances caused by insufficient learning data and to generate highly natural synthesized speech.

Also, the learning database used for generating the prosody generation model 23 is made the same as the learning database for generating density information, so that a speaker's features such as a peculiar vocalizing style and mannerisms can be expressed.

In addition to the data space dividing unit 1, density information extracting unit 2, prosody generating method selecting unit 3, prosody learning unit 4, and prosody generating unit 6, there may be provided a waveform generating unit that generates speech waveforms using the prosody information generated by the prosody generating unit 6. In this manner, when furnished additionally with the waveform generating unit, the prosody generator of this exemplary embodiment may be called a speech synthesizer as well. The waveform generating unit above may also be implemented by the CPU of a computer that runs in accordance with a program. That is, the CPU of the computer may function as the data space dividing unit 1, density information extracting unit 2, prosody generating method selecting unit 3, prosody learning unit 4, prosody generating unit 6, and the above-mentioned waveform generating unit in keeping with a suitable program. That program may be called a speech synthesizing program.

Example 1

Figure 6:
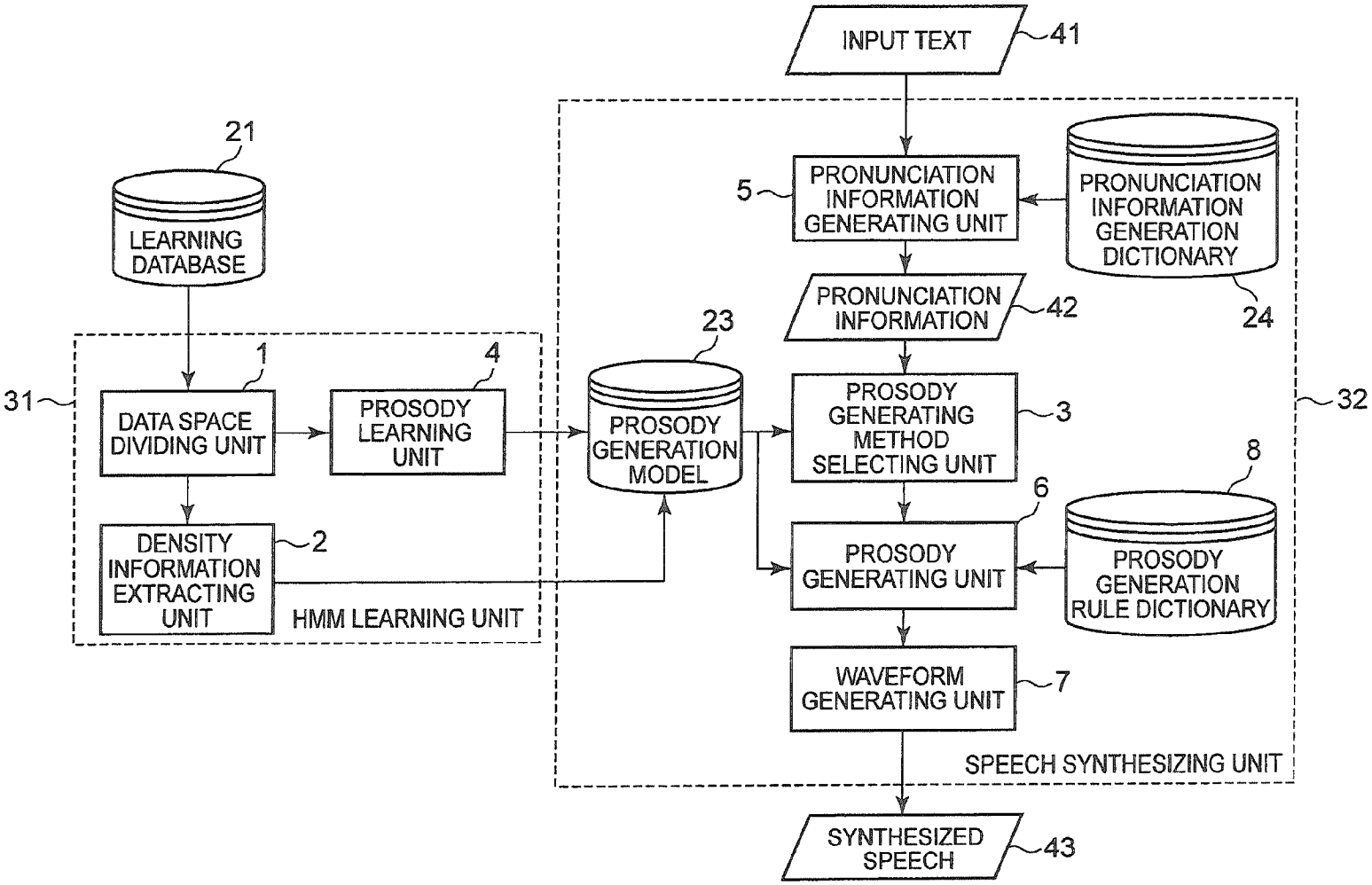

Explained below is an example of the speech synthesizer according to this invention. FIG. 6 is a block diagram showing a speech synthesizer as Example 1. The same elements as those explained above are designated by the same reference numerals used in FIGS. 1, 2 and 4.

It is assumed that the learning database 21 is prepared beforehand. The learning database 21 is an assembly of feature quantities extracted from large quantities of speech waveform data. In this example, the learning database 21 is assumed to include linguistic information such as phoneme strings and accent positions indicative of the details of generated speech data, F0 patterns as F0 time change information, segmentation information as duration time information about phonemes, and spectrum information obtained by subjecting speech waveforms to Fast Fourier Transform (FFT). These items of information are used as the learning data. It should be noted that the learning data is collected from the speech of one speaker.

The operations of the speech synthesizer of this example are roughly divided into two stages: a preparatory stage for preparing a prosody generation model through HMM learning, and a speech synthesis stage for actually performing speech synthesis processing. These stages will be explained below in order.

First, the data space dividing unit 1 and prosody learning unit 4 perform learning by a statistical method using the learning database 21. For this example, it is assumed that HMM is used as the statistical method and that the data space is divided by binary tree structure clustering. Where HMM is employed, clustering and learning are generally carried out alternately. Thus for the purpose of simplifying the explanation, it is assumed for this example that the data space dividing unit 1 and prosody learning unit 4 are integrated into an HMM learning unit 31 and that this unit is not explicitly shown to be structurally divided. This, however, does not apply if a statistical method other than HMM is utilized. It is also assumed that the density information extracting unit 2 is included in the HMM learning unit 31.

Figure 7:
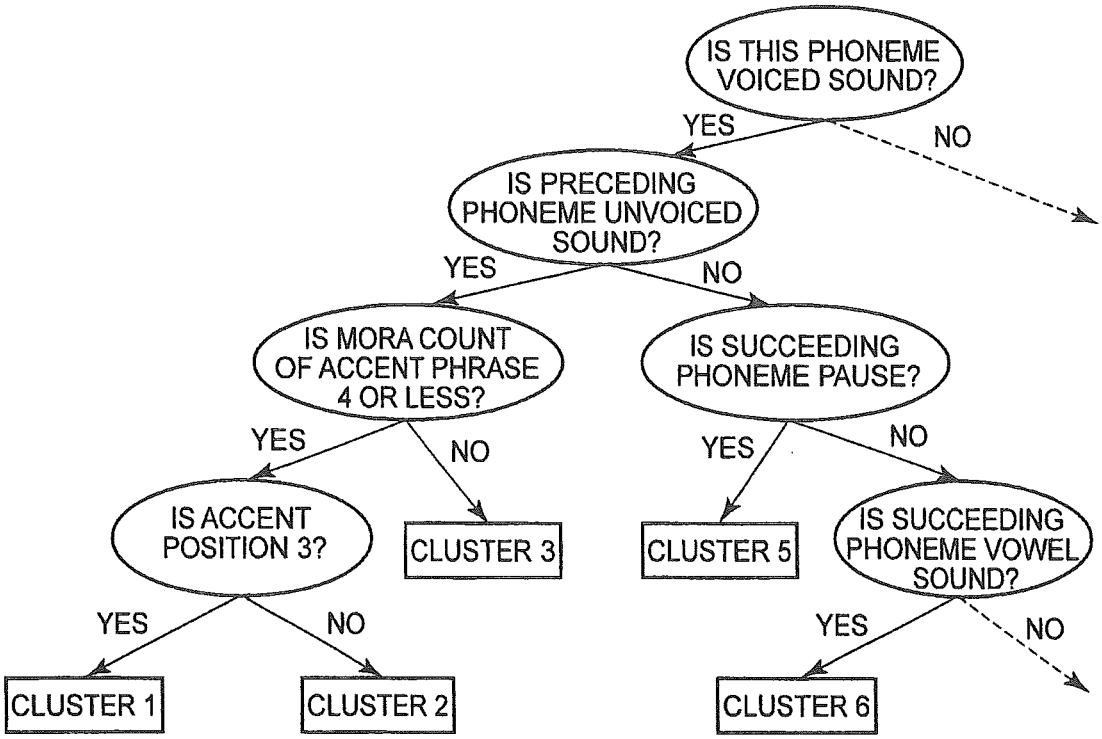
Figure 8:
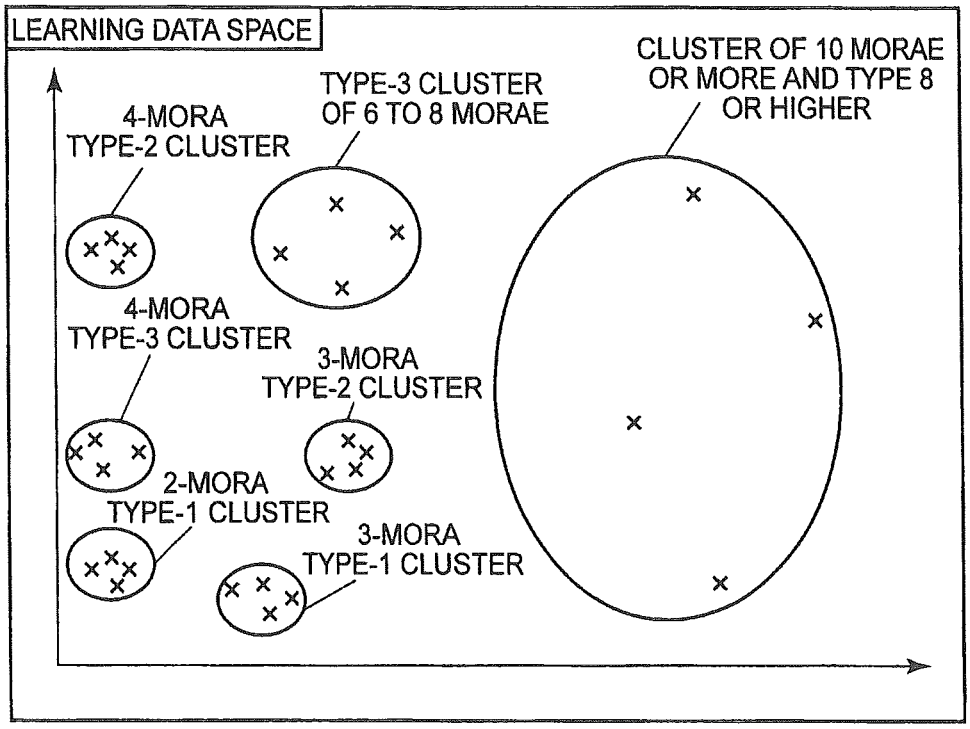

FIG. 7 shows an example of a result of learning by the HMM learning unit 31. FIG. 7 is a schematic view showing an example of a decision tree structure prepared by binary tree structure clustering. With binary tree structure clustering, a question assigned to each node causes the node in question to be divided into two nodes. The learning data space is divided into clusters so that the information quantity of each of the ultimately divided clusters is equalized. FIG. 8 is a schematic view showing a learning data space divided into clusters. FIG. 8 shows a case where the number of learning data belonging to each cluster is 4. As shown in FIG. 8, large clusters are generated in a space of sparse learning data, such as clusters of 10 morae or more and type 8 or higher. Such clusters are ones that have very sparse learning data in view of the cluster size.

Next, the density information extracting unit 2 extracts the density information about each cluster. With this example, linguistic information such as the mora counts of accent phrases, relative positions of accent nuclei, and the distinction of whether or not a given sentence is an interrogative sentence is used as the feature quantities for determining the density state. The density information extracting unit 2 extracts the density information using variance values regarding these items of information. At this point, with 3-mora type-1 clusters, all data constitute the 3-mora type-1 cluster and thus the variance value is 0. Also, it is assumed that the variance value of clusters of 6 to 8 morae and type 3 is $\sigma_A$ and that the variance value of clusters of 10 morae or more and type 8 or higher is $\sigma_B$. Alternatively, the density information extracting unit 2 may extract the density information from the result of the learning by HMM. The extracted density information is built into the prosody generation model 23 and associated with each cluster. As another alternative, a database retaining solely the density information may be prepared apart from the prosody generation model, and the density information and clusters may be associated with one another using a correspondence table or the like.

The preceding paragraphs have explained the preparatory stage in which the HMM learning unit 31 generates the prosody generation model. What follows is an explanation of the processing performed in the speech synthesis stage. A speech synthesizing unit 32 furnished to the speech synthesizer of this example includes a pronunciation information generating unit 5, a prosody generating method selecting unit 3, a prosody generating unit 6, and a waveform generating unit 7. And the speech synthesizing unit 32 retains a pronunciation information generation dictionary 24 and a prosody generation rule dictionary 8. For example, there may be provided a storing means (not shown) for storing the pronunciation information generation dictionary 24 and a storing means (also not shown) for storing the prosody generation rule dictionary 8.

First, a text 41 to be synthesized is input to the pronunciation information generating unit 5. The pronunciation information generating unit 5 generates pronunciation information 42 using the pronunciation information generation dictionary 24. Specifically, the pronunciation information generating unit 5 performs language analysis processing such as morphological analysis on the input text 41 and processes the result of the language analysis in a manner furnishing it with additional information for speech synthesis such as accent positions and accent phrase delimiters and with other modifications. Through such processing, the pronunciation information generating unit 5 generates the pronunciation information. Also, the pronunciation information generation dictionary 24 contains a dictionary for morphological analysis and a dictionary for furnishing the result of language analysis with additional information. For example, when a word "a ru ba- to a i n syu ta i n i ka da i ga ku (Albert Einstein College of Medicine)" in Japanese is input as the input text 41, the pronunciation information generating unit 5 outputs a character string "a ru ba- to a i N syu ta i N i ka da @ i ga ku" as pronunciation information 42, where @ indicates an accent position.

Next, the prosody generating method selecting unit 3 selects the prosody generating method based on the density information about each cluster. In this example, it is assumed that the prosody generating method selecting unit 3 selects the prosody information generating method for each accent phrase on the principle "The statistical model-based method is usually selected, with the rule-based method selected only for the accent phrases belonging to sparse clusters." Specifically, a threshold value of the variance value is set in advance. And the prosody generating method selecting unit 3 selects the rule-based method for the accent phrases belonging to the clusters of which the variance value is equal to or higher than the threshold value. That is, a sparse cluster is recognized when its variance value is equal to or higher than the threshold value. Also, the prosody generating method selecting unit 3 selects the statistical model-based method for the accent phrases belonging to the clusters of which the variance value is lower than the threshold value. In the case of this example, it is assumed that the threshold value of the variance value is represented by $\sigma_T$ and that $\sigma_T>\sigma_A$ and $\sigma_T<\sigma_B$. Since the variance value of 0 applies to 3-mora type-1 accent phrases, the prosody generating method selecting unit 3 selects the statistical model-based method for, say, "bo ku wa (I am)" and "ma ku ra (pillow)" in Japanese (3-mora type-1 accent phrases). Likewise, since $\sigma_T>\sigma_A$, the prosody generating method selecting unit 3 also selects the statistical model-based method for accent phrases belonging to type-3 clusters of 6 to 8 morae, such as "ka ku ka i ha tsu (nuclear development)" in Japanese (6 morae). Meanwhile, because $\sigma_T<\sigma_B$, the prosody generating method selecting unit 3 selects the rule-based method for accent phrases belonging to clusters of 10 morae or more and type 8 or higher, such as a word "a ru ba- to a i n syu ta i n i ka da i ga ku (Albert Einstein College of Medicine)" in Japanese (8 morae, type 15).

A specific method of selecting the prosody information generating method is explained below on the assumption that the speech of a sentence "wa ta shi wa kyo ne n ka ra a ru ba- to a i n syu ta i n i ka da i ga ku ni ryu- ga ku shi te i ru (I have been studying at Albert Einstein College of Medicine since last year)" in Japanese is to be synthesized. It is assumed that the pronunciation information generated by the pronunciation information generating unit 5 is "wa ta shi wa I kyo @ ne N ka ra i a ru ba- to a i N syu ta i N i ka da @ i ga ku ni ryu- ga ku shi te i ru," where "1" signifies an accent phrase boundary. In this case, because the first, the second, and the fourth accent phrases are 4-mora type 0, 5-mora type 1, and 8-more type 0, respectively, the prosody generating method selecting unit 3 selects the statistical model-based method for these phrases. On the other hand, because the third accent phrase is 19-mora type 15 and because $\sigma_T<\sigma_B$, the prosody generating method selecting unit 3 selects the rule-based method for this phrase.

Also, the HMM learning unit 31 learns a prosody generation model while dividing the data space, thereby preparing the prosody generation model. The prosody generating unit 6 generates prosody information by the prosody information generating method selected by the prosody generating method selecting unit 3. In this case, when the statistical model-based method is selected, the prosody generating unit 6 generates the prosody information using the prosody generation model 23; when the rule-based method is selected, the prosody generating unit 6 generates the prosody information using the prosody generation rule dictionary 8. If the prosody information about an accent phrase belonging to a sparse cluster is generated by the statistical model-based method, prosodic disturbance may occur due to an insufficient data quantity. By contrast, because the same result of clustering as that discussed above is applied to the prosody generation model and because the prosody generating method selecting unit 3 selects the rule-based method for accent phrases belonging to sparse clusters, the prosody information can be generated with little disturbance.

Finally, the waveform generating unit 7 generates the speech waveform based on the generated prosody information and pronunciation information. In other words, a synthesized speech 43 is generated.

With this example, the density information is assumed to be directly used when the prosody generating method selecting unit 3 selects the prosody information generating method. Alternatively, the prosody information generating method may be selected in accordance with a condition prepared automatically or manually based on the density information.

And when linguistic information such as the mora counts of accent phrases and the relative positions of accent nuclei is used as the feature quantities for determining the density information as with this example, these kinds of information have the advantage of being easy to interpret intuitively. Thus when not the density information extracted by the density information extracting unit 2 but the condition prepared manually based on the density information is to be used by the prosody generating method selecting unit 3 in determining the prosody information generating method, that condition has the advantage of being easy to prepare.

Although with this example, the learning database 21 is assumed to be a collection of data from one speaker's speech, the learning database 21 may also be a collection of data from the speech of a plurality of speakers. Where the learning database 21 prepared from a single speaker's speech is used, there can be the advantage of generating the synthesized speech reproducing the speaker's peculiarities such as his or her mannerisms; where the learning database 21 prepared from multiple speakers' speech is utilized, there can be the advantage of generating general-purpose synthesized speech.

Although with this example, the density information is assumed to be associated with each of the clusters of the prosody generation model, the prosody information generating method may be changed in accordance with a criterion established from the density information independently of the clusters of the prosody generation model. For example, suppose that based on the density information, the learning data turns out to be generally sparse regarding the accent phrases of 12 morae or more. In this case, the prosody generating method selecting unit 3 may select the role-based method for the accent phrases of 12 morae or more in accordance with the criterion "The rule-based method should apply wherever there exist 12 morae or more"; the prosody generating method selecting unit 3 may select the statistical model-based method regarding the accent phrases of less than 12 morae.

Example 2

Figure 9:
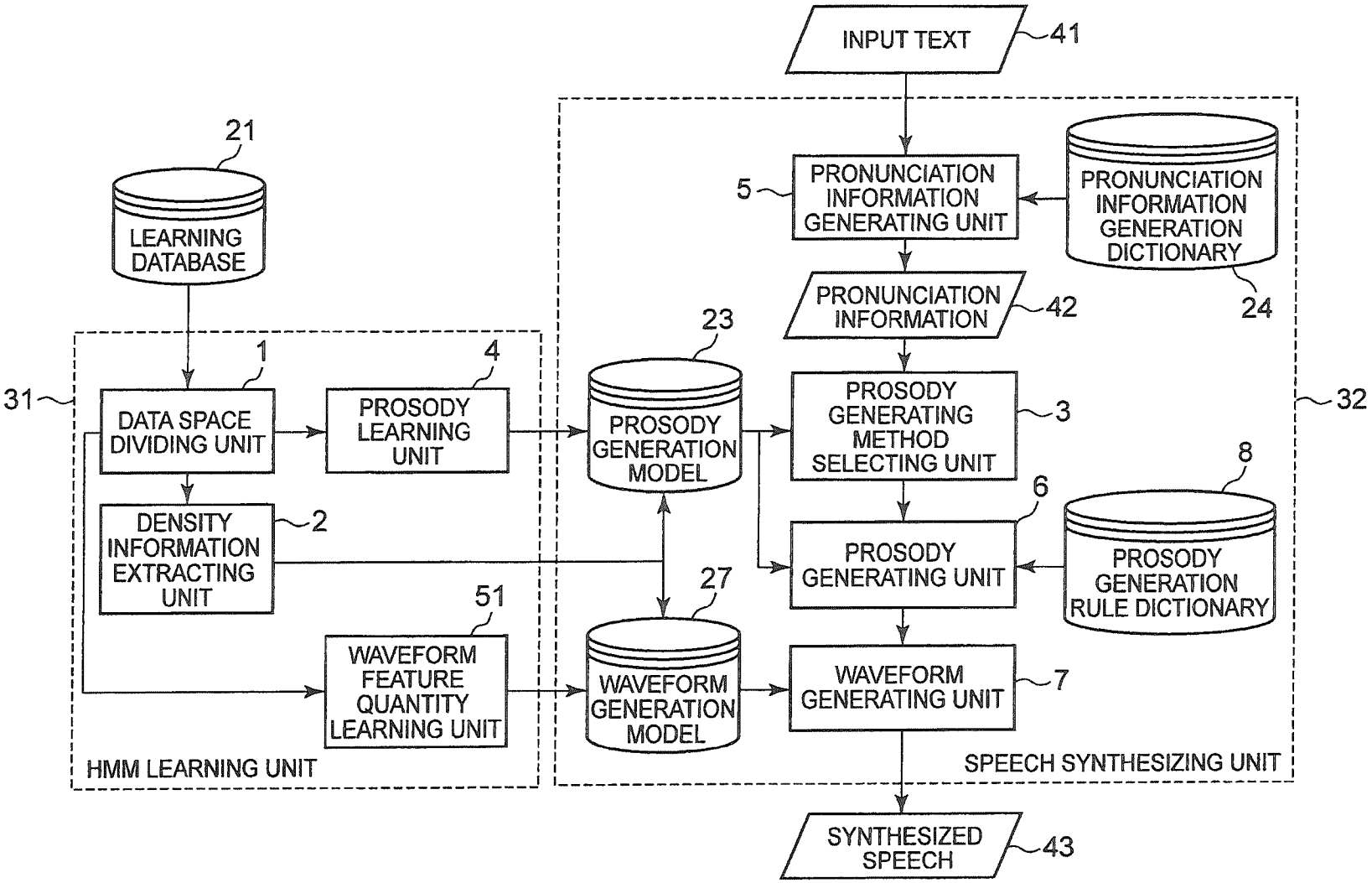

FIG. 9 is a block diagram showing a speech synthesizer as Example 2. The same elements as those of Example 1 are designated by the same reference numerals shown in FIG. 6, and these elements will not be discussed further. In the case of this example, the HMM learning unit 31 includes a waveform feature quantity learning unit 51 in addition to the data space dividing unit 1, density information extracting unit 2, and prosody learning unit 4.

With this example, the HMM learning unit 31 generates a prosody generation model 23 and a waveform generation model 27 using the learning database 21. Specifically, the waveform feature quantity learning unit 51 generates the waveform generation model 27.

The waveform generation model is a model derived from the waveform spectrum feature quantities in the learning database 21. Specifically, the feature quantities may be cepstral features or the like. Although the statistical model generated by HMM is used here as the data for waveform generation, some other speech synthesis method (e.g., waveform concatenation method) may be utilized instead. In that case, the prosody generation model 23 alone is learned with HMM, whereas the unit waveforms for use in waveform generation should preferably be generated from the learning database 21.

According to this example, when the waveform generating unit 7 generates a waveform using the waveform generation model belonging to a sparse cluster, degradation of sound quality in that portion can be prevented. There can also be the advantage of faithfully reproducing the features such as each speaker's mannerisms. Also, with the waveform concatenation method or the like not using HMM for waveform generation, there is an insufficient amount of the unit waveform data corresponding to the data belonging to clusters with sparse learning data. In such conditions, there can be the advantage of circumventing the degradation of sound quality because the data belonging to sparse clusters is not used.

Figure 10:
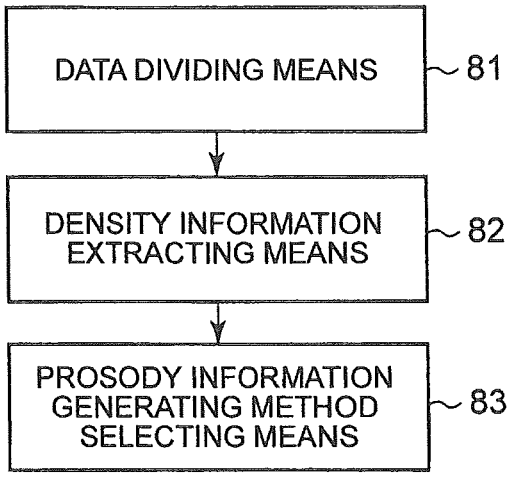

Minimum configurations of the present invention are explained next. FIG. 10 is a block diagram showing an example of a minimum configuration of the prosody generator according to this invention. The prosody generator of this invention includes a data dividing means 81, a density information extracting means 82, and a prosody information generating method selecting means 83.

The data dividing means 81 (e.g., data space dividing unit 1) divides the data space of a learning database (e.g., learning database 21) as an assembly of learning data indicative of the feature quantities of speech waveforms.

The density information extracting means 82 (e.g., density information extracting unit 2) extracts density information indicative of the density state in terms of information quantity of the learning data in each of the subspaces divided by the data dividing means 81.

The prosody information generating method selecting means 83 (e.g., prosody generating method selecting unit 3) selects either a first method (e.g., statistical model-based method) or a second method (e.g., rule-based method) as a prosody information generating method based on the density information, the first method involving generating the prosody information using a statistical technique, the second method involving generating the prosody information using rules based on heuristics.

The configuration explained above makes it possible to generate the prosody information for realizing highly natural speech synthesis without unnecessarily collecting large quantities of learning data.

Figure 11:
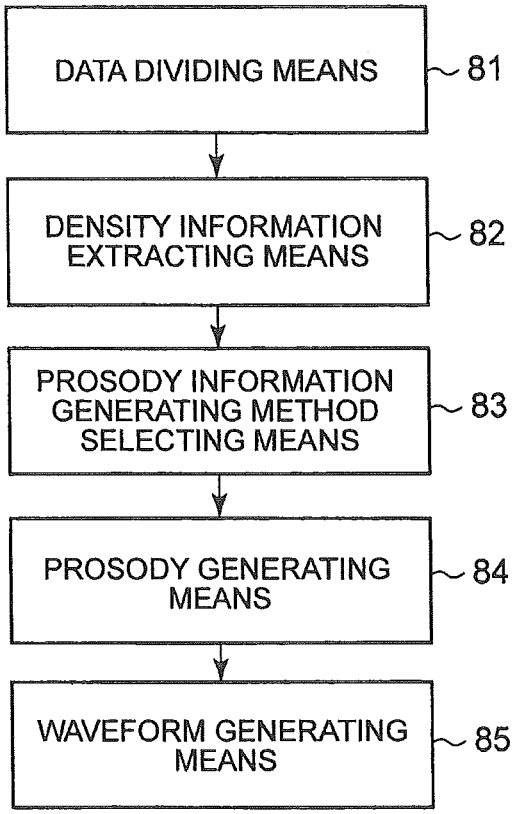

FIG. 11 is a block diagram showing an example of a minimum configuration of the speech synthesizer according to this invention. The speech synthesizer of this invention includes a data dividing means 81, a density information extracting means 82, a prosody information generating method selecting means 83, a prosody generating means 84, and a waveform generating means 85. The data dividing means 81, density information extracting means 82, and prosody information generating method selecting means 83 are the same as the corresponding elements shown in FIG. 10 and thus will not be discussed further.

The prosody generating means 84 (e.g., prosody generating unit 6) generates the prosody information by the prosody information generating method selected by the prosody information generating method selecting means 83.

The waveform generating means 85 (e.g., waveform generating unit 7) generates a speech waveform using the prosody information.

The configuration explained above provides the same effects as those offered by the prosody generator shown in FIG. 10.

Part or all of the above-described exemplary embodiments and examples may also be stated as in the following supplementary notes but not limited thereto:

(Supplementary note 1) A prosody generator including: a data dividing means which divides into subspaces the data space of a learning database as an assembly of learning data indicative of the feature quantities of speech waveforms; a density information extracting means which extracts density information indicative of the density state in terms of information quantity of the learning data in each of the subspaces divided by the data dividing means; and a prosody information generating method selecting means which selects either a first method or a second method as a prosody information generating method based on the density information, the first method involving generating the prosody information using a statistical technique, the second method involving generating the prosody information using rules based on heuristics.

(Supplementary note 2) A prosody generator described in supplementary note 1, further including a prosody generation model preparing means which prepares a prosody generation model representative of relations between speech and the prosody information by use of a learning database used to generate the density information.

(Supplementary note 3) A prosody generator described in supplementary note 1 or 2, in which the prosody information generating method selecting means selects either the first method or the second method in accordance with a condition prepared on the basis of the density information.

(Supplementary note 4) A prosody generator described in any one of supplementary notes 1 through 3, in which the density information extracting means extracts the density information using as the feature quantities the number of morae or accent positions in accent phrases.

(Supplementary note 5) A prosody generator described in any one of supplementary notes 1 through 4, in which the density information extracting means obtains variances of the feature quantities indicated by the learning data as the density information.

(Supplementary note 6) A speech synthesizer including: a data dividing means which divides into subspaces the data space of a learning database as an assembly of learning data indicative of the feature quantities of speech waveforms; a density information extracting means which extracts density information indicative of the density state in terms of information quantity of the learning data in each of the subspaces divided by the data dividing means; a prosody information generating method selecting means which selects either a first method or a second method as a prosody information generating method based on the density information, the first method involving generating the prosody information using a statistical technique, the second method involving generating the prosody information using rules based on heuristics; a prosody generating means which generates the prosody information by the prosody information generating method selected by the prosody information generating method selecting means; and a waveform generating means which generates a speech waveform using the prosody information.

(Supplementary note 7) A prosody generating method including: dividing into subspaces the data space of a learning database as an assembly of learning data indicative of the feature quantities of speech waveforms; extracting density information indicative of the density state in terms of information quantity of the learning data in each of the subspaces obtained by the division; and selecting either a first method or a second method as a prosody information generating method based on the density information, the first method involving generating the prosody information using a statistical technique, the second method involving generating the prosody information using rules based on heuristics.

(Supplementary note 8) A speech synthesizing method including: dividing into subspaces the data space of a learning database as an assembly of learning data indicative of the feature quantities of speech waveforms; extracting density information indicative of the density state in terms of information quantity of the learning data in each of the subspaces obtained by the division; selecting either a first method or a second method as a prosody information generating method based on the density information, the first method involving generating the prosody information using a statistical technique, the second method involving generating the prosody information using rules based on heuristics; generating the prosody information by the selected prosody information generating method; and generating a speech waveform using the prosody information.

(Supplementary note 9) A prosody generating program for causing a computer to execute: a data dividing process which divides into subspaces the data space of a learning database as an assembly of learning data indicative of the feature quantities of speech waveforms; a density information extracting process which extracts density information indicative of the density state in terms of information quantity of the learning data in each of the subspaces divided by the data dividing process; and a prosody information generating method selecting process which selects either a first method or a second method as a prosody information generating method based on the density information, the first method involving generating the prosody information using a statistical technique, the second method involving generating the prosody information using rules based on heuristics.

(Supplementary note 10) A speech synthesizing program for causing a computer to execute: a data dividing process which divides into subspaces the data space of a learning database as an assembly of learning data indicative of the feature quantities of speech waveforms; a density information extracting process which extracts density information indicative of the density state in terms of information quantity of the learning data in each of the subspaces divided by the data dividing process; a prosody information generating method selecting process which selects either a first method or a second method as a prosody information generating method based on the density information, the first method involving generating the prosody information using a statistical technique, the second method involving generating the prosody information using rules based on heuristics; a prosody generating process which generates the prosody information by the prosody information generating method selected by the prosody information generating method selecting process; and a waveform generating process which generates a speech waveform using the prosody information.

(Supplementary note 11) A prosody generator including: a data dividing unit which divides into subspaces the data space of a learning database as an assembly of learning data indicative of the feature quantities of speech waveforms; a density information extracting unit which extracts density information indicative of the density state in terms of information quantity of the learning data in each of the subspaces divided by the data dividing unit; and a prosody information generating method selecting unit which selects either a first method or a second method as a prosody information generating method based on the density information, the first method involving generating the prosody information using a statistical technique, the second method involving generating the prosody information using rules based on heuristics.

(Supplementary note 12) A prosody generator described in supplementary note 11, further including a prosody generation model preparing unit which prepares a prosody generation model representative of relations between speech and the prosody information by use of a learning database used to generate the density information.

(Supplementary note 13) A prosody generator described in supplementary note 11 or 12, in which the prosody information generating method selecting unit selects either the first method or the second method in accordance with a condition prepared on the basis of the density information.

(Supplementary note 14) A prosody generator described in any one of supplementary notes 11 through 13, in which the density information extracting unit extracts the density information using as the feature quantities the number of morae or accent positions in accent phrases.

(Supplementary note 15) A prosody generator described in any one of supplementary notes 11 through 14, in which the density information extracting unit obtains variances of the feature quantities indicated by the learning data as the density information.

(Supplementary note 16) A speech synthesizer including: a data dividing unit which divides into subspaces the data space of a learning database as an assembly of learning data indicative of the feature quantities of speech waveforms; a density information extracting unit which extracts density information indicative of the density state in terms of information quantity of the learning data in each of the subspaces divided by the data dividing unit; a prosody information generating method selecting unit which selects either a first method or a second method as a prosody information generating method based on the density information, the first method involving generating the prosody information using a statistical technique, the second method involving generating the prosody information using rules based on heuristics; a prosody generating unit which generates the prosody information by the prosody information generating method selected by the prosody information generating method selecting unit; and a waveform generating unit which generates a speech waveform using the prosody information.

This patent application claims priority to Japanese Patent Application No. 2011-120499 filed on May 30, 2011, the entire content of which is hereby incorporated by reference.

While the present invention has been explained in reference to specific embodiments, the invention is not limited thereto. Modifications and variations of the structures and other details of the invention may occur to those skilled in the art without departing from the scope of this invention.

INDUSTRIAL APPLICABILITY

The present invention can apply advantageously to the speech synthesizer or the like that uses the learning data of which the information quantity may be typically limited. For example, this invention can apply advantageously to the speech synthesizer or the like that reads aloud all kinds of text including news articles and auto-answer messages.

REFERENCE SIGNS LIST

1 Data space dividing unit
2 Density information extracting unit
3 Prosody generating method selecting unit
4 Prosody learning unit 6 Prosody generating unit
7 Waveform generating unit

The invention claimed is:

1. A prosody generator, comprising:

a data dividing unit implemented at least by a hardware including a processor and which divides into subspaces the data space of a learning database as an assembly of learning data indicative of feature quantities of speech waveforms;

a density information extracting unit implemented at least by a hardware including a processor and which extracts density information indicative of a density state in terms of information quantity of the learning data in each of the subspaces divided by the data dividing unit, a prosody information generating method selecting unit implemented at least by a hardware including a processor and which selects either a first method or a second method as a prosody information generating method based on the density information, the first method involving generating the prosody information using a statistical technique, the second method involving generating the prosody information using rules based on heuristics, wherein the prosody information generating method selecting unit selects the second method when the density information indicates the density state is sparse; and an output unit which outputs a generated synthetic speech based on the prosody information.

2. The prosody generator according to claim 1, further comprising:

a prosody generation model preparing unit implemented at least by a hardware including a processor and which prepares a prosody generation model representative of relations between speech and the prosody information by use of a learning database used to generate the density information.

3. The prosody generator according to claim 1, wherein the prosody information generating method selecting unit selects either the first method or the second method in accordance with a condition prepared on a basis of the density information.

4. The prosody generator according to claim 1, wherein the density information extracting unit extracts the density information using as the feature quantities a number of morae or accent positions in accent phrases.

5. The prosody generator according to claim 1, wherein the density information extracting unit obtains variances of the feature quantities indicated by the learning data as the density information.

6. The prosody generator according to claim 1, wherein the prosody information includes information that designates a sound pitch and a tempo of a synthesized speech.

7. The prosody generator according to claim 1, wherein the prosody information includes a time change of a fundamental frequency as a feature quantity representative of prosody.

8. The prosody generator according to claim 1, wherein the density information extracting unit determines the density state based on linguistic information including at least one of mora counts of accent phrases, relative positions of accent nuclei, and distinction of whether a given sentence is an interrogative sentence.

9. The prosody generator according to claim 1, wherein the density information extracting unit determines the density state based on linguistic information including mora counts of accent phrases, relative positions of accent nuclei, and distinction of whether a given sentence is an interrogative sentence.

10. A speech synthesizer, comprising:

a data dividing unit implemented at least by a hardware including a processor and which divides into subspaces the data space of a learning database as an assembly of learning data indicative of feature quantities of speech waveforms;

a density information extracting unit implemented at least by a hardware including a processor and which extracts density information indicative of a density state in terms of information quantity of the learning data in each of the subspaces divided by the data dividing unit;

a prosody information generating method selecting unit implemented at least by a hardware including a processor and which selects either a first method or a second method as a prosody information generating method based on the density information, the first method involving generating the prosody information using a statistical technique, the second method involving generating the prosody information using rules based on heuristics;

a prosody generating unit implemented at least by a hardware including a processor and which generates the prosody information by the prosody information generating method selected by the prosody information generating method selecting unit;

a waveform generating unit implemented at least by a hardware including a processor and which generates a speech waveform using the prosody information, wherein the prosody information generating method selecting unit selects the second method when the density information indicates the density state is sparse; and an output unit which outputs a generated synthetic speech based on the speech waveform using the prosody information.

11. The speech synthesizer according to claim 10, wherein the prosody information includes information that designates a sound pitch and a tempo of a synthesized speech.

12. The speech synthesizer according to claim 10, wherein the prosody information includes a time change of a fundamental frequency as a feature quantity representative of prosody.

13. The speech synthesizer according to claim 10, wherein the density information extracting unit determines the density state based on linguistic information including mora counts of accent phrases, relative positions of accent nuclei, and distinction of whether a given sentence is an interrogative sentence.

14. A prosody generating method, implemented by a processor, the method comprising:

dividing into subspaces the data space of a learning database as an assembly of learning data indicative of feature quantities of speech waveforms;

extracting density information indicative of a density state in terms of information quantity of the learning data in each of the subspaces obtained by the division selecting either a first method or a second method as a prosody information generating method based on the density information, the first method involving generating the prosody information using a statistical technique, the second method involving generating the prosody information using rules based on heuristics;

in the selecting either the first method or the second method, selecting the second method when the density information indicates the density state is sparse; and outputting a generated synthetic speech based on the prosody information.

15. The prosody generating method according to claim 14, wherein the prosody information includes information that designates a sound pitch and a tempo of a synthesized speech.

16. The prosody generating method according to claim 14, wherein the prosody information includes a time change of a fundamental frequency as a feature quantity representative of prosody.

17. The prosody generating method according to claim 14, wherein, in the extracting density information, the density state is determined based on linguistic information including mora counts of accent phrases, relative positions of accent nuclei, and distinction of whether a given sentence is an interrogative sentence.

* * * * *